United States Patent [19]

Fapiano

[11] 4,330,263

[45] May 18, 1982

[54] METHOD OF CONTROLLING A REHEAT FURNACE TO CONTROL SKID MARK EFFECTS

[75] Inventor: Donald J. Fapiano, Salem, Va.

[73] Assignee: General Electric Company, Salem, Va.

[21] Appl. No.: 239,393

[22] Filed: Mar. 2, 1981

[51] Int. Cl.[3] ..... F27D 3/00

[52] U.S. Cl. ..... 432/11; 266/80

[58] Field of Search ..... 432/11; 72/8; 266/80

[56] References Cited

U.S. PATENT DOCUMENTS

| | | | |
|---|---|---|---|
| 3,604,695 | 9/1971 | Steeper | 432/11 |
| 3,628,358 | 12/1971 | Fapiano | 72/8 |
| 3,695,594 | 10/1972 | Hollander | 432/11 |
| 4,257,767 | 3/1981 | Price | 266/80 |

OTHER PUBLICATIONS

"Influence of Skid Mark Design on Skid Mark Formation" by R. L. Howells, et al.; Journal of the Iron and Steel Inst. Jan. 1972.

"Formation of Skid Marks in a Slab-Reheating Furnace" by F. M. Salter; The Iron and Steel Engineer's Group of the Iron and Steel Institute, Energy Management of Iron and Steel Works, Publication No. 105, London, England, Apr. 1967 (pp. 151-174).

"Where Does the Energy Go? Design Basis vs Average Monthly Operation" by James E. Hovis; Iron and Steel Engineer, Dec., 1978.

*Primary Examiner*—John J. Camby

*Attorney, Agent, or Firm*—Arnold E. Renner; James H. Beusse

[57] ABSTRACT

A method for controlling, in a reheat furnace of the type having a heat zone through which metal work pieces are moved over support skids and a soak zone in which slab temperature differentials are reduced, the variations in deformation resistance of the workpiece due to temperature gradients produced by the skids. This method first provides for establishing, for the furnace and the workpiece to be rolled, an initial skid mark characteristic expressing, at the time the workpiece leaves the support skids and enters the soak zone, the ratio of the deformation resistance of the workpiece in a region immediately contiguous the skids to the deformation resistance of the workpiece in a second region which is located approximately mid-way between adjacent skids. A skid mark decay characteristic defining the decay of the skid mark characteristic as a function of time elapsed after the workpiece has left the skids is then established. From the use of the decay characteristic and the initial skid mark characteristic, the time the workpiece should remain in the soak zone in order for the workpiece to achieve satisfactory properties for subsequent rolling operations is determined.

Adaptive updating of the skid mark characteristic may be achieved by observing the actual forces occuring during the rolling process. The skid mark characteristic provides an indication of the condition of the support skid insulation and may assist in planning of furnace maintenance.

7 Claims, 8 Drawing Figures

METHOD OF CONTROLLING A REHEAT FURNACE TO CONTROL SKID MARK EFFECTS

BACKGROUND OF THE INVENTION

The present invention relates generally to the control of reheat furnaces used in association with metal rolling mills and more particularly to a method of controlling the use of the furnace for controlling the variations in deformation resistance of a workpiece to be rolled which variations are occasioned by the existence of support skids upon which the workpiece resides while within a portion of the furnace.

In the discipline of metal rolling, it is common practice to employ what is known as a reheat furnace to bring slabs or metal workpieces to the proper temperature for subsequent rolling. Such furnaces normally include at least one so-called heat zone and one soak zone. In the heat zone, heat is usually supplied to the workpiece, from burners located above and below the slab or workpiece which is pushed through the furnace while residing on a plurality of support skids. Quite often these skids take on the form of longitudinal pipes extending the length of the heat zone and having a hollow interior through which cooling fluid, such as water, is passed to prevent too rapid deterioration and to maintain the strength of the pipes. Insulating material such as a ceramic is placed upon the pipe such that the workpiece actually resides upon the the insulating material. The insulation is not, however, perfect. In addition, the skids shadow the workpiece from the burners such that temperature gradients (commonly called skid marks) exist within the metal workpiece. These gradients, if allowed to continue to exist at the time of rolling, result in differences in the deformation resistance of the material and increase the difficulty of rolling consistent gage metal.

Were the metal workpieces to be pushed through the furnace in the direction in which they are rolled, the skid marks would be along the length of the rolling path and would create no great problem. However, such a system would make the furnace inordinately long and it is, therefore, the customary practice to push slabs through the furnace such that they reside on the skids in a manner such that the skid marks are disposed transversely to the direction of rolling. As such, the skid marks represent a cyclic variation in material hardness during rolling which presents problems in maintaining consistent gage material.

Much has been written about skid marks and skid mark effects and much effort has gone into the design of the skids to minimize this effect. For more complete understanding of skid marks and their associated problems, reference is made to the following articles: "Influence of Skid Mark Design on Skid Mark Formation" by R. L. Howells, et al.; *Journal of the Iron and Steel Institute,* January, 1972; "Formation of Skid Marks in a Slab-Reheating Furnace" by F. M. Salter; *The Iron and Steel Engineer's Group of the Iron and Steel Institute, Energy Management of Iron and Steel Works,* Publication Number 105, London, England, April, 1967 (pages 151–174) and "Where Does the Energy Go? Design Basis vs. Average Monthly Operation" by James E. Hovis; *Iron and Steel Engineer,* December, 1978.

Automatic gage control is, of course, available in most hot rolling mills but if the skid marks are severe, such gage controls are often not adequate to compensate for the resulting variations in deformation resistance of the workpiece. Even where the gage control system is adequate to compensate for these variations, undesirable variations in workpiece shape and metalurgical quality may remain. Earlier mention was made of the soak zone and it is a primary purpose of the soak zone, in which the metal workpiece does not reside upon skids but sits on a continuous surface, to allow the skid mark effects to dissipate and for the slab to reach a more uniform temperature. It is, of course, one possible solution to leave the slabs in the soak zone for a sufficient length of time to insure that the skid marks will be completely dissipated under all expected operating conditions. This is not practical in most instances since this would reduce furnace efficiency and productivity and since there are practical economic limits to the design length of the soak zone. Neither is such completely necessary since some temperature gradient or skid mark effect is permissible so long as the effects are within acceptable limits.

The problems associated with skid marks are complicated by the fact that, as the insulation on the skids wears, the skid marks tend to be more pronounced. As pointed out in the Hovis article referenced above, the variation may be as much as four to one depending upon the condition of the insulation. It has been suggested to provide a model of the anticipated skid mark and to control the time in the soak zone as a function of this model. Since most modern hot rolling mills include some form of computer control, such modeling could be readily achieved. It is not practical to provide an accurate model for use over long periods of time, however, since it is not possible to accurately predict the manner in which the insulation will wear.

A further problem associated with the inability to accurately predict insulation wear is that of determining the appropriate time for replacing the skid insulation. At the present time, this determination is usually based upon the judgement of mill operating management without benefit of any quantitative evaluation of the skid mark effects on workpiece quality.

SUMMARY OF THE INVENTION

It is, therefore, an object of the present invention to provide an improved method of control for a reheat furnace associated with a metal rolling mill.

It is another object to provide a method for accurately predicting the length of time a metal workpiece should remain in a reheat furnace soak zone to allow the effects of skid marks to be brought within acceptable limits.

Still another object is to provide a method of establishing a minimum amount of time between delivery of a workpiece from the skids and discharge from the furnace to allow temperature gradients in the workpiece to achieve allowable limits for rolling.

A further object is to provide a method for assuring maximum allowable temperature gradients in a metal workpiece exiting from a reheat furnace and for updating stored criteria based upon forces observed during actual rolling.

A still further object is to provide a consistent criterion for defining the condition of skid insulation in a reheat furnace.

These and other objects are achieved in accordance with the method of the present invention which first establishes, for the furnace, an initial skid mark characteristic expressing, at the time the workpiece leaves the support skids and enters the soak zone, the ratio of the deformation resistance of the workpiece in the region immediately contiguous to one of the skids to the deformation resistance of the workpiece in the second region which is located approximately mid-way between adjacent skids. A skid mark decay characteristic defining the decay of the skid mark characteristic as a function of time elapsed after the workpiece has left the skids is then established. From the initial skid mark characteristics and the skid mark decay characteristic there is calculated an anticipated ratio of workpiece deformation resistance of the first region to the workpiece deformation resistance of the second region. This anticipated ratio is compared to a predetermined value and the time the workpiece is required to remain in the soak zone is then adjusted to assure that the ratio is within allowable limits. In another aspect of the invention, providing for updating of anticipated ratios, the actual forces occasioned by passing the workpiece between the rolls are observed and compared with those which were anticipated. If the forces are different than anticipated, the initial skid mark characteristic can be adjusted to compensate for factors such as errors in establishing the initial characteristic and changes in the characteristic due to wear of the skid insulation. The updated skid mark characteristic will thus follow the gradual deterioration of skid insulation and can be used as a criterion for skid insulation maintenance.

DESCRIPTION OF THE DRAWING

While the specification concludes with claims particularly pointing out and distinctly claiming what is regarded as the present invention, details of the preferred embodiments of the invention may be more readily ascertained from the following description when read with reference to the accompanying drawings in which:

DETAILED DESCRIPTION

Figure 1:
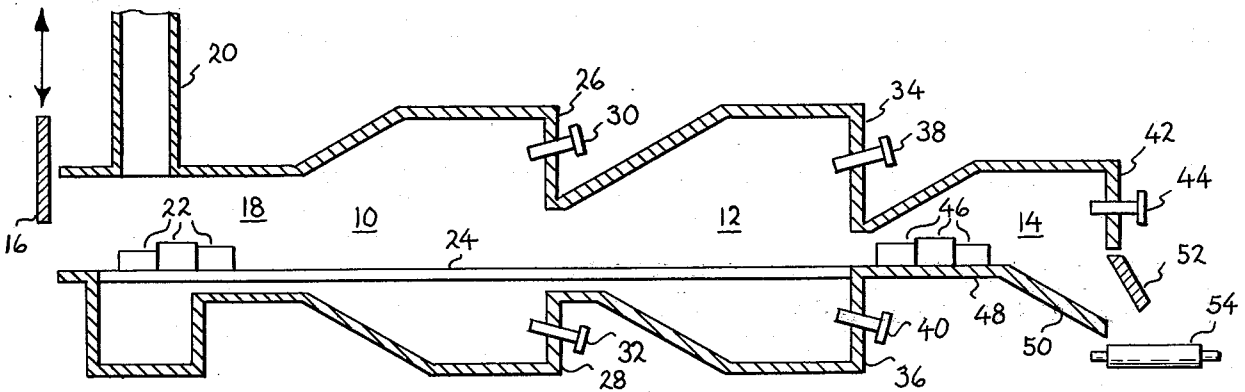
FIG. 1 is a simplified elevational view of a reheat furnace illustrating a typical basic reheat furnace structure and its operating zones.

Reference is now made to FIG. 1 which shows the basic structure and operation of a typical reheat furnace with respect to which the present invention might find application. The furnace includes a preheat zone 10, a heat zone 12 and soak zone 14. Workpieces or slabs (hereinafter referred to as slabs) are taken from a storage yard and placed into the reheat furnace one at a time through a charging door 16 leading to a throat 18 and the preheat zone 10. Three such slabs are indicated at 22 and it is seen that these slabs are not necessarily of the same thickness. As will be understood, when the furnace is fully charged, slabs will extend for the full length of the furnace to be discharged from the soak zone 14. An exhaust stack 20 coupled to the throat 18 passes exhaust gases from the reheat furnace.

Slabs entering the furnace through door 16 move along skids 24 which extend through the throat portion 18, the preheat zone 10 and the heat zone 12. The preheat zone 10 includes an upper firing wall 26 and a lower firing wall 28 in which are included, respectively, burners 30 and 32. Burners 30 and 32 represent what in actual practice would be a plurality of such burners extending across width of the furnace and which serve to maintain the temperature within the preheat zone 10. In a similar manner, the heat zone 12 includes upper and lower firing walls 34 and 36 containing, respectively, representative burners 38 and 40 to maintain the temperature within the heat zone 12. The soak zone 14 similarly contains an upper firing wall 42 having a representative burner 44 for maintaining heat in the soak zone 14. It is important to notice that in the soak zone, there is no lower firing wall and that the skids 24 terminate with the heat zone such that slabs, as illustrated at 46, in the soak zone reside upon a continuous surface 48.

As earlier indicated, when the furnace is completely charged, slabs will extend along the full length thereof. Thus, when a new slab is placed into the furnace by way of the charging door 16 the slabs are forced along the length of the furnace with the slab at the end of the soak zone being forced onto inclined discharge ramp 50 to exit the furnace by way of the discharge door 52. Slabs exiting by way of door 52 fall on to a roller table 54 for delivery to the rolling mill. The actual furnace will, of course, contain a large number of features which have not been illustrated in the FIG. 1 since they are not pertinent to the present invention. For a more complete description of the furnace and its operation in total, reference is made, for example, to U.S. Pat. No. 3,604,695 "Method and Apparatus for Controlling a Slab Reheat Furnace" by Donald E. Steeper, which patent is assigned to the assignee of the present invention.

Figure 2:
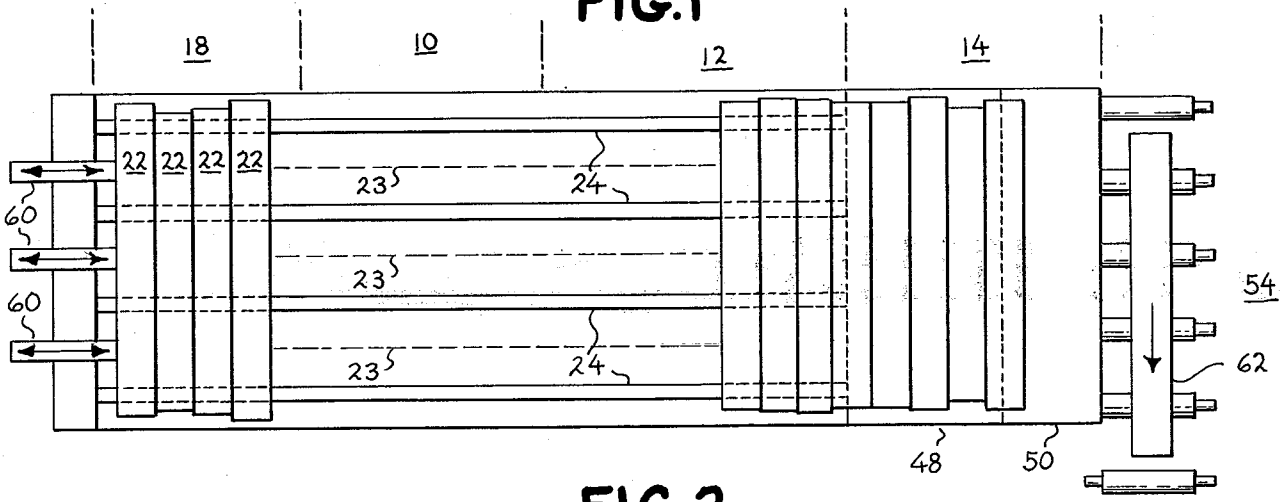
FIG. 2 is a simplified top plan view of a reheat furnace interior illustrating, particularly, the support skids upon which the metal workpieces reside while traveling through the furnace.

FIG. 2 shows in diagramatic form a top plan view of the furnace interior in which there is included a plurality of slabs 22 within the throat portion 18. These slabs rest upon a plurality of support skids 24. In FIG. 2, the skids are shown extending through the throat 18, the preheat zone 10 and the heat zone 12. As indicated by the dashed lines 23, the slabs would be continuous in a fully loaded furnace such that when a new slab is placed in the furnace through the charging door 16 (not illustrated in FIG. 2) and pushed by pushing rods illustrated at 60, slabs would be forced through the furnace and down the inclined ramp 50 onto the roller table 54 as illustrated by slab 62. The entire number of slabs has not been shown in FIG. 2 in order to more clearly illustrate the skids 24.

The method of propelling slabs through the furnace just described is for "pusher" type furnaces. Another method of moving slabs through a furnace employs the so called "walking beam" arrangement which lifts the entire furnace charge on movable supports and advances it a predetermined distance, normally about two feet, before returning it to the stationary supports. Walking beam furnaces have different skid mark characteristics, but are similar in those details essential to the application of this invention.

Figure 3:
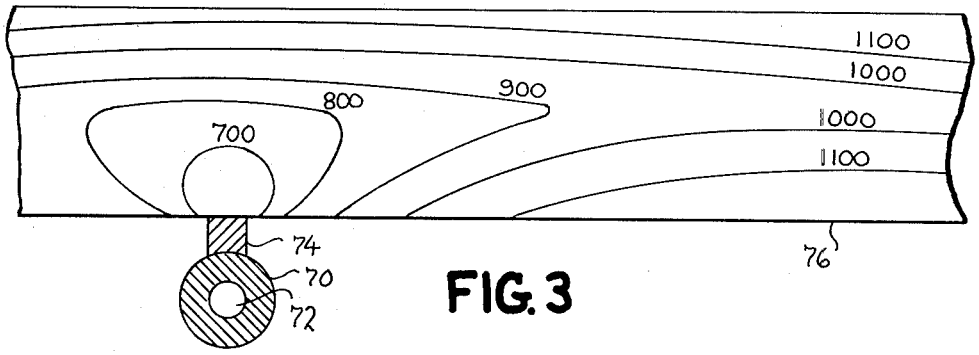
FIGS. 3 and 4 are diagrams illustrating typical temperature gradients such as might exist in a metal workpiece after leaving the skids of the furnace.
Figure 4:
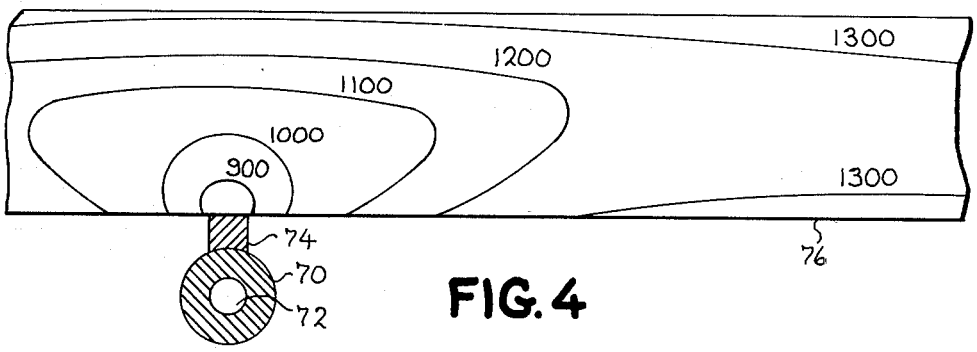

FIGS. 3 and 4 illustrate temperature gradients such as might exist within a slab during periods of residency as they are pushed through the furnace preheat and heat zones and further illustrate a representative physical structure of the skids themselves. Referencing those figures, first with respect to the skids, it will be remembered that it was earlier stated that the skids are often fluid cooled. As such, the skids are illustrated in cross section as a pipe 70 having an internal bore 72 through which a suitable coolant such as water is passed. An insulation material such as a ceramic bar 74 is placed upon the pipe to provide an insulating support for the workpiece. While round skids having ceramic insulation have been illustrated in FIGS. 3 and 4, a variety of skid configurations are known and have been proposed. For a more complete discussion of these, reference is made to the articles earlier cited, particularly that of Slater. The gradient lines are simply for purposes of illustration and are similar to those as shown in the Slater article. FIG. 3 illustrates the temperature gradients which might exist after the slab has resided on the skids for a first period, for example, one-half hour. It is seen that even though insulation is provided between the pipe 70 and the slab itself, this insulation is not perfect and that a certain amount of heat transfers from the slab to the pipe. In addition, the skid tends to shade the slab from the radiant heat. Thus, in that portion of the slab immediately adjacent the skid the temperature might be in the range of 700° C. As the distance away from the skid increases the slab temperature increases so that, in this example, the slab temperature at the most distant point away from the skid might approach 1100° C. FIG. 4 shows that as the slab remains upon the skids for a longer period of time, for example one hour, the overall temperature of the slab 76 increases but the temperature gradients remain. The depictions of FIGS. 3 and 4 are, of course strictly illustrative and the exact temperature gradient will vary in accordance with a number of factors such as the slab dimensions, furnace configuration and the actual skid design employed. Most of these factors are relatively constant or predictable for a given furnace and a slab of known dimensions and composition. One large variable, however, is that associated by insulation wear occasioned by the slabs movement through the furnace. It is believed readily apparent that with increased wear the insulating value of the material will decrease and thus the temperature gradients will become more pronounced.

Once the slabs have left the heat zone (and the skids) and reside in the soak zone they rest upon a continuous surface. The temperature gradients lines will now diminish and the slab as a whole will approach a more even temperature. The longer the length of time that the slabs remain in the soak zone, the less pronounced the temperature gradients within the slab will be. As earlier mentioned, however, factors such as production schedules may limit residence time in the soak zone.

While the top-to-bottom temperature gradients equalize in several minutes after leaving the water cooled skids, the longitudinal gradients, which represent a much larger heat transfer path, will not vanish completely in the normal soak zone residence time. At the time of rolling, therefore, the average temperature through the slab thickness will vary along the slab length.

The deformation resistance $\partial F/\partial H$ varies with temperature according to relationships well known in the art, for example, that described in U.S. Pat. No. 3,628,358 cited earlier. The variations in average temperature will therefore appear as variations in deformation resistance at the time of rolling. Since these variations in deformation resistance, and the thickness variations which result, are of primary concern in rolling operations, it is convenient to characterize the skid mark intensity in terms of relative deformation resistance along the slab length.

Figure 5:
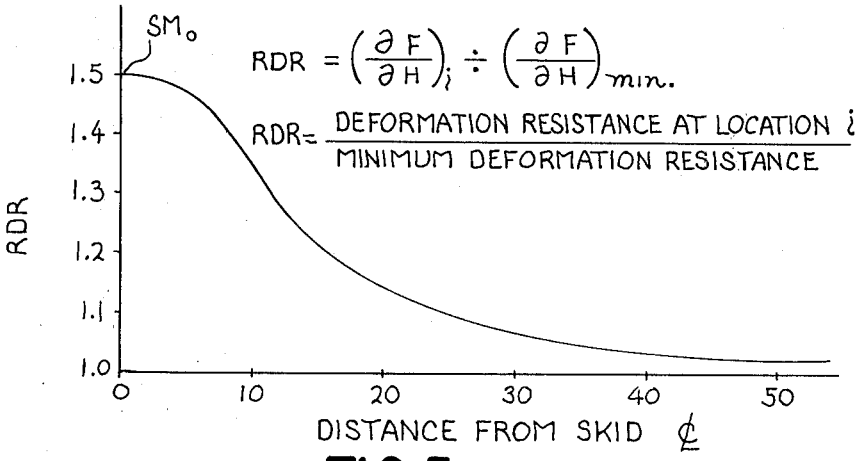
FIG. 5 is a graphical illustration showing the ratio of the workpiece deformation resistance at the skid marks to the deformation resistance at a distance from the skid marks.

FIG. 5 illustrates a typical plot of relative deformation resistance, RDR, which is the ratio of the deformation resistance $\partial F/\partial H$ at various positions along the slab to the minimum deformation resistance which would, as was earlier indicated, occur at approximately the midpoint between adjacent skid marks at the moment the slab leaves the skids. The actual values would, of course, vary with dimensions of the slab, the length of time in the furnace, etc., and FIG. 5 is therefore only a representative illustration. The value $SM_o$ is, defined as the value of RDR at the skid center line. The value of $SM_o$ is, in this particular example, equal to approximately 1.50. This means that, if the slab were to be rolled at this instant, the rolling force at the skid mark would be about 50 percent greater than the force midway between skid marks.

The first step of the method of the present invention is to establish an initial skid mark characteristic ($SM_o$) which it is anticipated the slab will have as it enters the soak zone. While such a characteristic is capable of being mathematically derived by methods such as set forth in the Salter article earlier cited, a more practical way of selecting this initial characteristic is by selection from empirically derived values based upon past rolling practice as will be described. Based upon these values and through the use of a decay characteristic such as will next be described with respect to FIG. 6, an initial value of $SM_o$ for the slab as it enters the soak zone of the furnace can be obtained. These values, primarily dependent upon slab dimensions and heat zone residency time can be retained, for example, as by storage in the memory of a computer.

Figure 6:
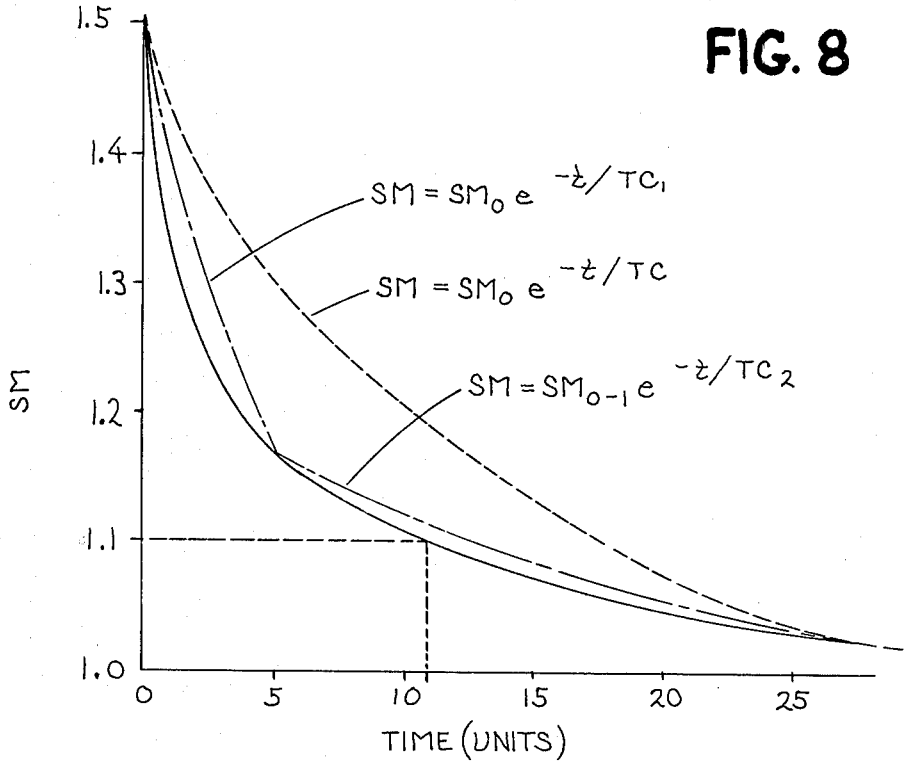
FIG. 6 is a graph illustrating the decay in the deformation resistance of a metal workpiece with respect to time.
Figure 7:
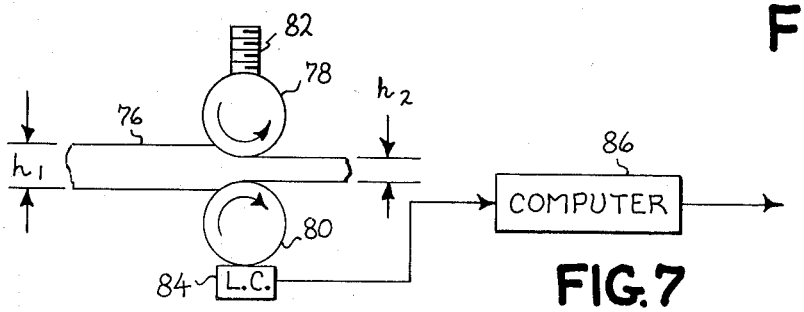
FIG. 7 is a simplified diagram illustrating a typical rolling mill stand and providing output proportional to rolling force.

FIG. 6 illustrates a typical skid mark decay characteristic which plots, as a function of the time the slab remains in the soak zone, the value of the skid mark characteristic SM. The values of SM shown in FIG. 6 are a continuation of the example begun with respect to FIG. 5; ie, an initial SM value ($SM_o$) of about 1.50. These curves are similar to those which are illustrated in the Howell, et al, article previously mentioned. Three curves are shown illustrating three possible methods of determining required values using suitable equipment such as a computer 86 (FIG. 7 to be discussed). The curve shown by the solid line is an actual decay characteristic such as might be determined empirically or in accordance with established models as a starting point and could be stored in the computer in the form of look-up tables. If it were not desired to use look-up tables, one alternative method is illustrated by the dashed line which represents the exponential formula: $SM=SM_oe^{-t/TC}$. In this formula, SM represents the skid mark value after time t, $SM_o$ represents the initial skid mark characteristic, e is the fundamental constant equal to approximately 2.718, TC is a time constant which is calculated or empirically derived and varies with accordance with slab thickness. The dot-dash line in FIG. 6 represents a third way of storing the skid mark decay characteristic in the computer by using two different time constants for successive time periods in accordance with the formula given above and results in closer approximation of the actual decay characteristic than would the single exponential formula. As illustrated, the first time period dot-dash curve is from 0 to 5 units while the second time period is from 5 units on. The values of $SM_o$ used would be those existing at the beginnings of the respective time periods and the values of TC would, of course be different for each of the two periods. Were still greater accuracy desired, a greater number of time periods could be employed.

It is to be realized that while only a single characteristic (in three derivations) is shown in FIG. 6, a family of such curves would, in practice, exist. Primarily, for a given furnace, the various curves of the family would each be related to a specific slab thickness (or range of thickness depending upon the accuracy desired). If greater sophistication and greater accuracy were desired, the family of curves could be further correlated to such parameters as slab width and the material of the slab.

In accordance with the method of the present invention, as earlier described, there is first established an anticipated initial skid mark characteristic for the particular slab as it exits from the skids of the furnace heat zone into the soak zone. The particular characteristic selected will be based upon known parameters such as the slab dimensions, the slab material and the length of time the slab was within the heat zone(s). A skid mark decay characteristic such as is shown in FIG. 6 is then accessed to determine how long the slab must remain in the soak zone to achieve a suitable value of SM to allow rolling in accordance with the confines and capabilities of the overall rolling mill, particularly the automatic gage control. In the illustrated example using the solid curve in FIG. 6, assuming the initial skid mark characteristic $SM_o$ was 1.50, and it was known that the rolling mill was capable of not adequately compensating for ratio variations greater than 1.1, it is seen that the slab would have to remain in the soak zone for approximately eleven time units as illustrated. Thus, with these facts known, the total rolling mill schedule could be adjusted and the push rate of the furnace adjusted to assure that the workpiece remains in the soak zone a sufficient length of time to achieve the maximum allowable effects from the skid marks. The adjustment of the operation pacing could be automatic or left to operator discretion. In either case the skid mark intensity, SM, could be displayed to the mill operator for the slab next to be discharged from the furnace to provide a continuous quantitative measure of skid mark severity.

In accordance with another aspect of the present invention, adaptive updating of the stored anticipated initial values of $SM_o$ and the skid mark decay characteristic (FIG. 6) can be made through the use of actual force measurements as will now be discussed.

Referencing now FIG. 7, there is shown, in highly simplified form, a rolling mill in which a slab 76 is passed between a pair of work rolls 78 and 80 to reduce the thickness of that slab from an entry thickness $h_1$ to an exit thickness $h_2$. As is known in the art, the rolls 78 and 80 are driven by suitable means such as electric motors. The rolls are maintained a prescribed distance apart to effect the reduction in the workpiece by an appropriate loading means illustrated as a screw down system 82. The force occasioned by passing the slab through the rolls can be measured by a conventional load cell illustrated by block 84 and these values of force can be supplied to a suitable processing system illustrated generally as a computer 86. Computer 86, as is well known in the art, employs inputs such as rolling force, roll speed, etc., to perform various computations and provide prescribed output results. For example, the rolling force can be used to derive the temperature of the slab as is set forth in U.S. Pat. No. 3,628,358 "Method of Revising Workpiece Temperature Estimates or Measurements Using Workpiece Deformation Behavior" issued Dec. 21, 1971, in the name of Donald J. Fapiano, et al., which patent is assigned to the assignee of the present invention.

Figure 8:
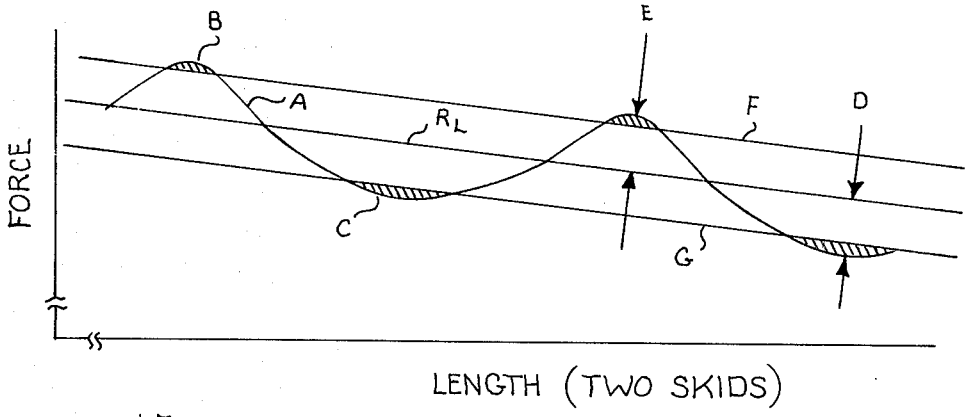
FIG. 8 is a graphical representation of rolling forces that might be experienced in rolling an individual workpiece.

FIG. 8 illustrates a typical force characteristic as a function of a portion of the slab length such as might be observed were the force readings from the load cell 84 of FIG. 7 to be plotted. The line $R_L$ represents the average force which is required in the reduction process and the slope of that line is an indication of the fact that as the slab passes through the mill, the tail end tends to be cooler than the head end due to the longer period of time since leaving the furnace. Hence, the overall force requirements for reduction tend to be greater. The force eccentricities of the head and tail ends of the slab have been specifically omitted from FIG. 8 since they will not follow the generally uniform pattern of the more central portions of the slabs. As is well known, the force required to achieve the desired deformation defines the deformation resistance which is normally defined by the amount of change in force required to get a change in thickness. Line A which varies in a generally cyclic manner represents the actual force observations which might be experienced as the slab is being rolled. It is seen that line A varies from a maximum force value at B corresponding to portion of the slab which was directly over the skid (the lowest temperature) to a minimum value at C which would normally correspond to a portion of the slab midway between adjacent skids, (the highest temperature). Value D represents the maximum deviation below the average force while Value E represents the maximum deviation above the average force which would be required in rolling the slab.

Since it is necessary to separate the skid mark influence from the influence of head to tail temperature gradients, some care must be taken in interpreting the actual force profile.

One method is to store force values obtained at predetermined intervals of workpiece length. In a roughing stand of a hot strip mill, for example, these intervals might represent one to two feet of workpiece length. After discarding those measurements in the length intervals within about two feet of either end, a linear equation relating force to workpiece length is calculated using well-known linear regression techniques. Graphically, this is illustrated in FIG. 8 as line $R_L$. Line F is calculated with slope equal to the slope of line $R_L$ and with intercept calculated to cause a predetermined percentage of force measurements to fall above line F. In a similar manner, line G is calculated to fall above a predetermined percentage of force measurements. The measurements lying outside of the band included within lines F and G should be about five percent to ten percent of the total force measurements.

The value of line F at mid-length divided by the value of line G at mid-length may be defined as the current skid mark value. It is best obtained as soon as practical after the workpiece leaves the furnace, such at the first or second pass in a reversing mill or the first or second stands of a continuous mill.

If the rolling force variations experienced when the slab is actually rolled do not agree with the anticipated variations, then the skid mark characteristic $SM_o$ is presumed to be in error. The observed variations data can then be used in known adaptive update techniques to modify the $SM_o$ value.

The measured value of SM is used with the decay curve of FIG. 6 and the known elapsed time since leaving the skids to calculate a new estimate of $SM_o$. During initial operations, $SM_o$ values can be updated with high gains making it unnecessary to have accurate start-up estimates of $SM_o$ for a particular furnace. The update strategy during start-up, for example, might be:

$$SM_o(\text{new}) = SM_o(\text{old}) \cdot 0.8 + SM_o(\text{calculated}) \cdot 0.2.$$

After twenty to thirty slabs have been rolled the weighting of $SM_o$ (calculated) can be reduced from the 0.2 value to approximately 0.03 to 0.05 for greater stability.

Another aspect of the present invention is the additional knowledge gained concerning the use of the skid mark characteristic $SM_o$ as an indication of the condition of the skid insulation. As the insulation wears, greater amounts of heat will be lost from the slab where it resides on the skids. The current value of $SM_o$ can be used as an indication of insulation condition.

While there has been shown and described what is at present considered to be the preferred embodiment of the present invention, modifications thereto will readily occur to those skilled in the art. For example, that described is the initial skid mark characteristic $SM_o$ and its decay characteristics in terms of relative deformation resistance, since this makes more convenient the later comparison with rolling forces. It is possible, and essentially equivalent, to describe the initial skid mark characteristic and its decay in terms of mean effective temperature difference. The observed rolling force variations would then be converted to equivalent temperature differentials to be used in updating the initial skid mark characteristic. It is not desired, therefore, that the invention be limited to this specific embodiment shown and described and it is intended to cover, in the appended claims, all such modifications as fall within the true spirit and scope of the invention.

What is claimed is:

1. For use in association with a reheat furnace of the type having at least one heat zone, including support skids over which metal workpieces are moved, and a soak zone in which such workpieces reside for a period of time after leaving the supporting skids of the heat zone prior to being acted upon by a metal rolling mill, a method for controlling said furnace to limit, to acceptable levels, the variations in the deformation resistance of the workpiece during rolling operations due to temperature variations in the workpiece resulting from contact with such skids, said method comprising the steps:

(a) establishing for the furnace and the workpiece an initial skid mark characteristic expressing, at the time the workpiece leaves the supporting skids and enters the soak zone, the anticipated ratio of deformation resistance of the workpiece in at least one first region which was immediately contiguous to a one of the skids to the deformation resistance of a workpiece in a second region which was located approximately mid-way between adjacent skids;

(b) establishing a skid mark decay characteristic defining the decay of said skid mark characteristic as a function of time elapsed after the workpiece has left the skids;

(c) determining from said skid mark characteristic and said decay characteristic, the anticipated ratio of workpiece deformation of said first region to the workpiece deformation resistance of said second region at the expected time of rolling a workpiece;

(d) comparing said anticipated ratio to a predetermined value; and (e) adjusting, as necessary, the time period of said workpiece remains in said soak zone based upon the results of said comparison.

2. The invention in accordance with claim 1 wherein said step of adjusting the time periods is achieved by adjusting the rate at which workpieces are moved through the furnace.

3. The invention in accordance with claim 1 wherein the step of establishing the skid mark decay characteristic is achieved utilizing values, stored in a computer memory located look-up table, defining a curve.

4. The invention in accordance with claim 1 wherein the step of establishing the skid mark decay characteristic is achieved by storing values in a computer memory located look-up table defining an empirically derived curve.

5. The invention in accordance with claim 1 wherein the step of establishing the skid mark decay characteristic is achieved by storing, in a computer, at least one exponential equation defining an approximation of the actual decay characteristic, said equation having the general form: $SM = SM_o e^{-t/TC}$, wherein:

SM = Skid mark at time t, $SM_o$ = initial skid mark characteristic, e = 2.718 (approximate), TC = an empirically derived constant, t = time leaving the skids.

6. The invention in accordance with claim 5 wherein at least two exponential curves are stored, each of said curves being applicable to a different period of time.

7. The invention in accordance with claim 1 further including the method of updating the initial skid mark characteristic based upon actual rolling experience comprising the steps:

(a) measuring the workpiece deformation along a predetermined length of said workpiece as it is rolled;

(b) determining the variation in workpiece deformation resistance attributable to the effect of the skids;

(c) calculating from said skid mark decay characteristic and the time elapsed since the workpiece left the supporting skids, the initial skid mark which would have produced the observed difference in the workpiece deformation resistances; and (d) adjusting the previously determined initial skid mark characteristic as a function of the difference between said initial skid mark characteristic and an initial skid mark characteristic which would produce the measured difference in workpiece deformation resistances.

* * * * *